US005273643A

United States Patent [19]

Hasegawa et al.

[11] Patent Number: 5,273,643

[45] Date of Patent: Dec. 28, 1993

[54] METHOD OF PRODUCING ZINC-CHROMIUM ALLOY PLATED STEEL SHEET WITH EXCELLENT PLATING ADHESIVENESS

[75] Inventors: Kazuhiro Hasegawa; Hiroki Nakamaru; Kazuo Mochizuki; Tomokatsu Katagiri; Nobuyuki Morito; Shigeo Kurokawa, all of Chiba, Japan

[73] Assignee: Kawasaki Steel Corporation, Japan

[21] Appl. No.: 46,764

[22] Filed: Apr. 13, 1993

[30] Foreign Application Priority Data

Apr. 16, 1992 [JP] Japan ..... 4-096631

[51] Int. Cl.[5] ..... C25D 7/06

[52] U.S. Cl. ..... 205/155; 205/156; 205/244

[58] Field of Search ..... 205/155, 156, 244

[56] References Cited

FOREIGN PATENT DOCUMENTS 67188 4/1982 Japan .
55398 3/1989 Japan .
309998 12/1989 Japan .

*Primary Examiner*—T. M. Tufariello
*Attorney, Agent, or Firm*—Austin R. Miller

[57] ABSTRACT

The present invention provides a method of producing a zinc-chromium alloy-plated steel sheet having excellent properties such as bare corrosion resistance, corrosion resistance after coating, plating adhesiveness and weldability.

The method is characterized by plating the surface of the steel sheet using an acid plating bath containing zinc ion ($Zn^{2+}$) and chromium ion ($Cr^{3+}$) at a molar concentration ratio of about $0.1 \leqq Cr^{3+}/(Zn^{3+}+Cr^{3+}) \leqq 0.9$ in a total amount of at least about 0.5 mol/l within the dissolution range, and about 0.1 to 30 g/l of at least one nonionic organic additive having at least a triple bond, at a bath temperature of about 25° to 70° C. and a pH of about 1.0 to 4.0 with a current density of about 50 to 200 A/dm$^2$.

4 Claims, No Drawings

METHOD OF PRODUCING ZINC-CHROMIUM ALLOY PLATED STEEL SHEET WITH EXCELLENT PLATING ADHESIVENESS

BACKGROUND OF THE INVENTION

2. Field of the Invention

The present invention relates to a method for producing a zinc-chromium alloy-plated steel sheet having excellent corrosion resistance and excellent plate adhesion.

1. Description of the Related Art

Galvanized steel sheets are widely used as rust-preventive steel sheets for automobiles, household electric appliances, construction materials and the like. This is effective because since a pure zinc layer is less noble relative to iron of the steel sheet, the zinc layer has a sacrificial anticorrosion effect in that the zinc is first corroded in formation of plating defects such as pinholes or the like and portions where the matrix iron is exposed by processing and these portions are covered by corrosion products, thereby preventing rusting of the steel sheet. However, the zinc layer has a fault that because pure zinc is active, the corrosion thereof very rapidly develops in a corrosive environment such as a spray of salt water or the like. In addition, another possible cause of insufficient corrosion resistance is that since pure zinc easily produces conductive ZnO as a corrosion product, the protective effect deteriorates due to the presence of the corrosion product on the surface. An improved plating method using Zn-Ni, Zn-Fe or the like has been proposed in place of the pure galvanized steel sheet. In recent years, Zn-Cr alloy plating and a method of producing a Zn-Cr alloy-plated steel sheet have also been proposed.

Methods of producing an electroplated steel sheet using a plating bath containing chromium are disclosed in Japanese Patent Laid-Open Nos. 57-67188, 64-55398 and 1-309998.

The method disclosed in Japanese Patent Laid-Open No. 57-67188 uses an electroplating bath containing 70 to 370 g/l sulfate ion, 45 to 60 g/l nickel ion, 0.5 to 13 g/l chromium ion and 10 to 80 g/l boric acid, the bath being kept at a pH value of 1.4 to 2. The amount of chromium contained in the plating bath used in this method is 1.0 wt. % at most, and any anticorrosion effect of chromium can hardly be expected. The chromium content must be further increased for improving the corrosion resistance.

Japanese Patent Laid-Open No. 64-55398 discloses a method of producing a zinc-chromium-plated steel sheet with excellent surface quality and corrosion resistance, wherein plating is effected with a current density of at least 50 A/dm$^2$ by using an acid plating bath containing zinc ions, trivalent chromium ions and 0.01 to 20 g/l of polyoxyalkylene derivative. This method permits the Cr content in the plating to be increased to about 40 wt. %. However, the plated layer exhibits poor adhesion, and is thus easily peeled off from a steel sheet in both the adhesion tests below.

In the so-called reverse TO adhesion test a cellophane tape is applied to the plated layer surface, the plated steel sheet is bent at 180° on the cellophane tape side and is returned to its initial form. the cellophane tape is separated, and the amount of plated layer which adheres to the cellophane tape is weighed for determining the amount of peeling of the plated layer.

In the usual cellophane tape peeling test a cellophane tape is applied to the plated layer and is then forcibly separated therefrom, and the amount of peeling of the plated layer is determined from the weight of the plated layer which adheres to the cellophane tape.

In addition, since segregation of Cr occurs within a region of a high current density of at least 60 A/dm$^2$ and causes a stripe pattern in the plating, this method is not necessarily a satisfactory plating method.

Japanese Patent Laid-Open No. 1-309998 discloses a method of producing an electroplated steel sheet with excellent corrosion resistance and surface glossiness, wherein electroplating is performed by using an acid plating bath containing Cr ions and a cation polymer and having a ratio of $Cr^{6+}$ ion/ $Cr^{3+}$ ion of 0.1 or less. The specification also discloses that a quaternary amine polymer is used as the cationpolymer. Although this method is capable of producing a Zn-Cr alloy-plated steel sheet, the method has the problems that the concentration of the cationpolymer cannot easily be kept constant because the cationpolymer is easily entrapped in the plated layer, and that although the adhesion of the layer plated with a low current density (50 A/dm$^2$) is good, the adhesion of the plated layer obtained by plating with a current density of more than this value abruptly decreases. Further, although both Japanese Patent Laid-Open Nos. 64-55398 and 1-309998 take the amount of Cr deposition into consideration, improvements not only in corrosion resistance but also in adhesion are important problems. However, both specifications fail to describe improvement of adhesion.

SUMMARY OF THE INVENTION

Accordingly, an object of the present invention is to provide a method of producing a zinc-chromium alloy-plated steel sheet having excellent plating adhesiveness and corrosion resistance after processing.

It has now been found that a zinc-chromium alloy-plated steel sheet having excellent plate adhesion and corrosion resistance after processing can be obtained by using a specific plating bath under specific plating conditions.

In accordance with a first aspect of the present invention, there is provided a method of producing a zinc-chromium alloy-plated steel sheet having excellent plating adhesiveness by plating the surface of the steel sheet using an acid plating bath containing zinc ions ($Zn^{2+}$) and chromium ions ($Cr^{3+}$) at a molar concentration ratio of about $0.1 \leqq Cr^{3+}/(Zn^{2+}+Cr^{3+}) \leqq 0.9$ in a total amount of at least about 0.5 mol/l within the dissolution range, and about 0.1 to 30 g/l of at least one nonionic organic additive having at least a triple bond, at a bath temperature of about 25° to 70° C. and a pH of about 1.0 to 4.0 with a current density of about 50 to 200 A/dm$^2$.

The nonionic organic additive having at least a triple bond is expresses by either of the following formulas:

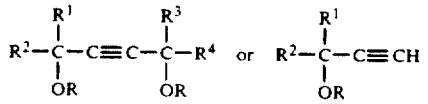

wherein the number of carbon atoms which form a molecule is within the range of from about 10 to 800, wherein $R^1$, $R^2$, $R^3$ and $R^4$ each being at least one selected from a group consisting of phenyl group, naphthalene group, anthracene group, phenol group, naphthol group, anthranol group, alkyl-group adducts and/or alkylene-group adducts and/or sulfonic acid-group adducts of these groups, hydrogen, hydroxyl group, alkyl group, alkylene group, alkoxyl group or its polymer, and sulfonic acid group, and wherein R is at least one selected from a group consisting of hydrogen, alkoxyl group or its polymer.

Preferred examples of nonionic organic additives each having at least a triple bond include acetylene alcohols, acetylene glycols and derivatives thereof.

DETAILED DESCRIPTION OF EMBODIMENT

A method of producing a zinc-chromium alloy-plated steel sheet of the present invention is described in further detail below.

The plating bath used for Zn-Cr alloy plating in the present invention comprises $Zn^{2+}$ ions and $Cr^{3+}$ ions as main metal ions, which are prepared in various known ways as by dissolving as sulfates, etc. The total concentration of these $Zn^{2+}$ ions and $Cr^{3+}$ ions is at least about 0.5 mol/l within the dissolution range. Namely, with a total concentration of less than about 0.5 mol/l, the surface is easily burnt deposited. On the other hand, with a total concentration beyond the dissolution range, a solid is produced, and significant improvement of appearance color tone and uniform electrodeposition properties is not achieved.

Further, the Zn content in the plated layer is controlled to be about 60 wt. % to 95 wt. %, and the molar ratio of $Cr^{3+}/(Zn^{2+}+Cr^{3+})$ in the plating bath is set to a value of about 0.1 to 0.9. With a ratio of less than about 0.1, the amount of chromium contained in the plated layer obtained cannot be increased, and thus a plated layer having excellent corrosion resistance cannot be obtained. Inversely, with a ratio of more than about 0.9, the Zn content in the plated layer cannot be easily controlled to be at least about 60 wt. %, thereby deteriorating the adhesion between the plated layer and the steel sheet.

The plating bath may contain as a conductive auxiliary at least one member selected from the group consisting of $K_2SO_4$, $Na_2SO_4$, $(NH_4)_2SO_4$, $CaSO_4$ and $MgSO_4$. In this case, the plating bath preferably contains at least about 10 g/l of such an auxiliary. The conductive auxiliary is added for improving the conductivity of the plating solution, decreasing the consumption of electric power and decreasing the burnt depositing of the surface.

The current density is about 50 to 200 A/dm$^2$, preferably about 70 to 150 A/dm$^2$. With a current density of less than about 50 A/dm$^2$, the deposition of Cr is hardly obtained, and with a current density of more than about 200 A/dm$^2$, the surface is easily burnt deposited, thereby deteriorating the adhesion of the plated layer.

The bath temperature is preferably about 25° to 70° C. At less than about 25° C., the adhesion between the plated layer obtained and the steel sheet deteriorates, and at more than about 70° C., the appearance tends to become black.

The pH value is preferably about 1.0 to 4.0. With a pH value of less than about 1.0, not only the efficiency of cathodic deposition is decreased, but also the apparatus used is significantly corroded. With a pH value of more than about 4.0, precipitation of zinc hydroxide significantly occurs.

In the present invention, at least one nonionic organic additive having at least a triple bond is added to the plating bath in order to obtain a Zn-Cr alloy-plated layer having excellent adhesion and a uniform alloy composition. The nonionic organic additive having at least a triple bond is a compound expressed by the following formulas:

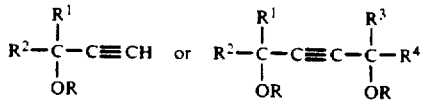

wherein $R^1$, $R^2$, $R^3$ and $R^4$ each being at least one selected from a group consisting of phenyl group, naphthalene group, anthracene group, phenol group, naphthol group, anthranol group, alkyl-group adducts and/or alkylene-group adducts and/or sulfonic acid-group adducts of these groups, hydrogen, hydroxyl group, alkyl group, alkylene group, alkoxyl group or its polymer, and sulfonic acid group, and wherein R is at least one selected from a group consisting of hydrogen, alkoxyl group or its polymer.

The number of carbon atoms which form a molecule of the nonionic organic additive is preferably within the range of about 10 to 800, more preferably about 10 to 250. With a carbon number of less than about 10, the formation of a complex with the metal ions contained in the plating bath becomes unstable, and a eutectoid of both metal ions cannot be easily be formed due to a large change in polarization. With a carbon number of more than about 800, a portion near the triple bond exhibits high steric hindrance, and the adhesion on the surface of the steel sheet thus significantly deteriorates, thereby causing difficulties in obtaining a plated layer with glossiness. With a carbon number of less than about 250, the adsorption on the surface of the steel sheet is improved, and the glossiness of the plated layer is consequently improved. Acethylene alcohols, acethylene glycols and derivatives thereof are particularly preferred. Typical examples of such nonionic organic additives each having at least a triple bond include the following compounds:

(1) 3-methyl-1-butene-3-ol

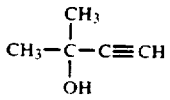

(2) 2,5-dimethyl-3-hexyne-2,5-diol

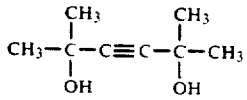

(3) 2,4,7,9-tetramethyl-5-decyne-4,7-diol

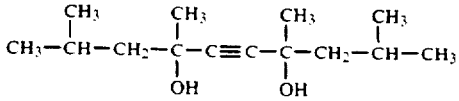

(4) ethylene oxide addition product of compound (3)

-continued

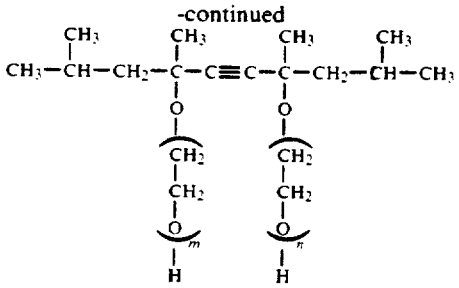

where m + n ≦ about 196

(5) ethylene oxide addition products of compound (2)

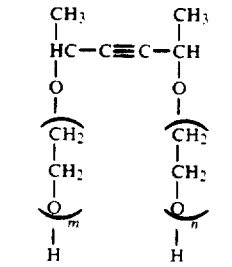

where m + n ≦ about 198

The addition of at least one of the above compounds each having at least a triple bond causes the formation of fine crystal grains in the Zn-Cr alloy plated layer, and significantly improves the glossiness and the uniform electrodeposition property of the solution. Although the reasons for the effect of such additives are not entirely clear, it is thought that the additives have the effect of holding the plated layer on the metal surface caused by both the $\pi$-electrons of the triple bond and the hydrogen bonds, and the effect of forming a complex with $Zn^{2+}$ ions. The appropriate amount of the additive added is within the range of about 0.1 to 30 g/l. With an amount of less than about 0.1 g/l, the deposition of Cr metal is decreased, and a plated layer having a good alloy composition cannot be easily obtained. If the amount of the additive added exceeds about 30 g/l, the effects are saturated, and burst depositing of the plated layer is caused.

The plated layer obtained by the above-described production method has a Zn content of about 60 to 95 wt. %, and exhibits a uniform color tone of a white gray to silver white and more excellent plate adhesion, without forming a stripe pattern.

The Zn-Cr alloy plating method of the present invention can be applied to Zn-Cr binary alloy electroplating and electroplating of an alloy mainly consisting of Zn and Cr, for example, Zn-Cr-P, Zn-Cr-Ni, Zn-Cr-$Al_2O_3$, Zn-Cr-Ti and Zn-Cr-Fe alloy plating.

EXAMPLE

Although the present invention is described in detail below with reference to examples, the present invention is not limited to the examples.

Examples 1 to 37 and Comparative Examples 1 to 29

The powdering resistance and corrosion resistance after processing of each of the zinc-chromium alloy plated sheet sheets produced by the processes below were evaluated. Experimental conditions and evaluation results are shown in Tables 1—1 to 1—6, 2—1 to 2—4. Large numbers of carbons per molecule may be added and will produce the results which are shown in Tables 3—1 and 3—2.

1. Specimen
   Cold rolled steel sheet for deep drawing: thickness 0.7 mm
2. Processes
   degreasing—water washing—pickling—plating—water washing—drying—evaluation of powdering resistance and corrosion resistance after processing
3. Conditions
   (1) Degreasing
   Electrolysis was effected by using a steel sheet as an anode in an aqueous solution containing 30 g/l of sodium hydroxide and 1 g/l of surfactant at a temperature of 60° C. for 10 sec. with a current density of 20 A/dm².
   (2) Pickling
   A steel sheet was pickled in an aqueous solution of 10 g/l of sulfuric acid at a temperature of 30° C. for a dipping time of 5 sec.
   (3) Plating apparatus
   System: Liquid flow cell
   Anode (electrode): Zn
   Anode-cathode distance: 10 mm
   Flow rate of plating solution: 1 m/sec
   (4) Plating bath

| | |
|---|---|
| $Zn^{2+}$ | 0.5 to 1.50 mol/l |
| $Cr^{3+}$ | 0.1 to 2.50 mol/l |
| $Cr^{2+}/(Zn^{2+} + Cr^{3+})$ | 0.143 to 0.909 |
| Organic additive | 0 to 28 g/l |

(5) Plating conditions
   Bath temperature: 35° to 80° C.
   Current density: 40 to 180 A/dm²
   Current-carrying time: 5.56 to 25.0 sec.
   (6 Powdering resistance
   A reverse TO test was performed by bending a steel sheet at 180° so that the test surface to which a cellophane tape was applied was on the inside without producing a gap in the bent portion, and was then returned to a substantially flat state. The plated layer rising was peeled by a cellophane tape, and the amount of the plated layer peeled was measured by fluorescent X-rays. The powdering resistance was evaluated on the basis of the following criteria:

| Peeling amount | Evaluation Symbol |
|---|---|
| 10 mg/m² or less | ◎ |
| 10 to 100 mg/m² | ○ |
| 100 to 1000 mg/m² | Δ |
| 1000 mg/m² or more | x |

(7) Corrosion Resistance
   A zinc-chromium alloy-plated steel sheet was cut in a size of 75×150 mm and was subjected to phophating, electrodeposition coating, intermediate coating and final coating. The time taken until rust occurred was examined by a composite cycle corrosion test (CCT) comprising spraying salt water for 4 hr, drying at 60° C. for 2 hr and humidity at 50° C. for 2 hr. The corrosion resistance was evaluated on the basis of the following criteria:

| Time to occurrence of rust | Evaluation symbol |
|---|---|
| 100 days or more | ⊙ |
| 50 to 100 days | ○ |
| 20 to 50 days | Δ |
| 20 days or less | x |

(8) Surface glossiness

The zinc-chromium alloy-plated steel sheet obtained was visually evaluated on the basis of the following criteria:

| Color tone | Evaluation symbol |
|---|---|
| White | ○ |
| Gray | Δ |
| Black or at least two tones | x |

TABLE 1-1

| | | $Zn^{2+}$ (mol/l) | $Cr^{3+}$ (mol/l) | $Cr^{3+}/(Zn^{2+}+Cr^{3+})$ | Organic Additive | Moles of Epoxy Groups Added | No. of Carbons per Molecule | Added Amount (g/l) | Conductive Auxiliary (g/l) | Anion | pH | Current Density ($A/dm^2$) | Current-Carrying Time (sec) | Bath Temperature (°C.) |
|---|---|---|---|---|---|---|---|---|---|---|---|---|---|---|
| Example | 1 | 0.55 | 0.55 | 0.500 | TMDDE | 20 | 52 | 2 | $Na^+$, 50 | $SO_4^{2-}$ | 1.5 | 80 | 12.5 | 50 |
| | 2 | 0.55 | 0.80 | 0.593 | TMDDE | 20 | 52 | 2 | $Na^+$, 50 | $SO_4^{2-}$ | 1.5 | 80 | 12.5 | 50 |
| | 3 | 0.55 | 1.00 | 0.645 | TMDDE | 30 | 72 | 2 | $Na^+$, 50 | $SO_4^{2-}$ | 1.5 | 80 | 12.5 | 50 |
| | 4 | 0.55 | 1.25 | 0.694 | TMDDE | 30 | 72 | 2 | $K^+$, 50 | $SO_4^{2-}$ | 1.5 | 80 | 12.5 | 50 |
| | 5 | 1.00 | 0.50 | 0.333 | TMDDE | 10 | 32 | 2 | $K^+$, 50 | $SO_4^{2-}$ | 1.5 | 80 | 12.5 | 50 |
| | 6 | 1.00 | 0.80 | 0.444 | TMDDE | 10 | 32 | 2 | $K^+$, 50 | $SO_4^{2-}$ | 1.5 | 80 | 12.5 | 50 |
| | 7 | 1.00 | 1.20 | 0.545 | TMDDE | 10 | 32 | 2 | $K^+$, 50 | $SO_4^{2-}$ | 1.5 | 80 | 12.5 | 50 |
| | 8 | 1.50 | 0.75 | 0.333 | TMDDE | 30 | 72 | 2 | $K^+$, 50 | $SO_4^{2-}$ | 1.5 | 80 | 12.5 | 50 |
| | 9 | 1.50 | 1.00 | 0.400 | TMDDE | 30 | 72 | 2 | $K^+$, 50 | $SO_4^{2-}$ | 1.5 | 80 | 12.5 | 50 |
| | 10 | 1.50 | 1.50 | 0.500 | TMDDE | 30 | 72 | 2 | $K^-$, 50 | $SO_4^{2-}$ | 1.5 | 80 | 12.5 | 50 |

TMDDE indicates ethylene oxide addition product of 2,4,7,9-tetramethyl-5-decyne-4, 7-diol.

TABLE 1-2

| | | $Zn^{2+}$ (mol/l) | $Cr^{3+}$ (mol/l) | $Cr^{3+}/(Zn^{2+}+Cr^{3+})$ | Organic Additive | Moles of Epoxy Groups Added | No. of Carbons per Molecule | Added Amount (g/l) | Conductive Auxiliary (g/l) | Anion | pH | Current Density ($A/dm^2$) | Current-Carrying Time (sec) | Bath Temperature (°C.) |
|---|---|---|---|---|---|---|---|---|---|---|---|---|---|---|
| Example | 11 | 1.20 | 0.50 | 0.294 | TMDDE | 30 | 72 | 2 | $Na^+$, 50 | $SO_4^{2-}$ | 1.0 | 80 | 12.5 | 50 |
| | 12 | 1.20 | 0.50 | 0.294 | TMDDE | 30 | 14 | 6 | $Na^+$, 50 | $SO_4^{2-}$ | 1.5 | 80 | 12.5 | 50 |
| | 13 | 1.20 | 0.50 | 0.294 | TMDDE | 30 | 14 | 6 | $Na^+$, 50 | $SO_4^{2-}$ | 2.5 | 80 | 12.5 | 50 |
| | 14 | 1.20 | 0.50 | 0.294 | TMDDE | 30 | 14 | 6 | $Na^+$, 50 | $SO_4^{2-}$ | 1.0 | 100 | 10.0 | 50 |
| | 15 | 1.20 | 0.50 | 0.294 | TMDDE | 30 | 14 | 6 | $Na^+$, 50 | $SO_4^{2-}$ | 1.0 | 120 | 8.33 | 50 |
| | 16 | 1.20 | 0.50 | 0.294 | TMDDE | 30 | 14 | 6 | $Na^+$, 50 | $SO_4^{2-}$ | 1.0 | 150 | 6.67 | 50 |
| | 17 | 1.20 | 0.50 | 0.294 | TMDDE | 30 | 14 | 6 | $Na^+$, 50 | $SO_4^{2-}$ | 1.0 | 180 | 5.56 | 50 |
| | 18 | 1.20 | 0.50 | 0.294 | TMDDE | 30 | 72 | 2 | $Na^+$, 50 | $SO_4^{2-}$ | 1.0 | 100 | 10.0 | 35 |
| | 19 | 1.20 | 0.50 | 0.294 | TMDDE | 30 | 72 | 2 | $Na^+$, 50 | $SO_4^{2-}$ | 1.0 | 100 | 10.0 | 60 |
| | 20 | 1.20 | 0.50 | 0.294 | TMDDE | 30 | 72 | 2 | $Na^+$, 50 | $SO_4^{2-}$ | 1.0 | 100 | 10.0 | 65 |

TMDDE indicates ethylene oxide addition product of 2,4,7,9-tetramethyl-5-decyne-4, 7-diol

TABLE 1-3

| | | $Zn^{2+}$ (mol/l) | $Cr^{3+}$ (mol/l) | $Cr^{3+}/(Zn^{2+}+Cr^{3+})$ | Organic Additive | Moles of Epoxy Groups Added | No. of Carbons per Molecule | Added Amount (g/l) | Conductive Auxiliary (g/l) | Anion | pH | Current Density ($A/dm^2$) | Current-Carrying Time (sec) | Bath Temperature (°C.) |
|---|---|---|---|---|---|---|---|---|---|---|---|---|---|---|
| Example | 21 | 1.20 | 0.50 | 0.294 | TMDDE | 80 | 172 | 2 | $Na^+$, 50 | $SO_4^{2-}$ | 1.0 | 100 | 10.0 | 60 |
| | 22 | 1.20 | 0.50 | 0.294 | TMDDE | 100 | 212 | 2 | $Na^+$, 50 | $SO_4^{2-}$ | 1.0 | 100 | 10.0 | 60 |
| | 23 | 0.55 | 0.35 | 0.389 | TMDDEA | 100 | 218 | 2 | $Na^+$, 80 | $SO_4^{2-}$ | 1.0 | 120 | 8.33 | 60 |
| | 24 | 0.55 | 0.45 | 0.450 | TMDDEA | 50 | 118 | 2 | $Na^+$, 80 | $SO_4^{2-}$ | 1.0 | 150 | 6.67 | 60 |
| | 25 | 1.05 | 0.35 | 0.250 | TMDDEB | 100 | 222 | 1 | $Na^+$, 80 | $SO_4^{2-}$ | 1.5 | 120 | 8.33 | 50 |
| | 26 | 1.05 | 0.50 | 0.322 | TMDDEB | 50 | 122 | 1 | $Na^+$, 80 | $SO_4^{2-}$ | 1.5 | 150 | 6.67 | 50 |
| | 27 | 1.50 | 0.40 | 0.211 | TMDDEA | 100 | 218 | 1 | $Na^+$, 40 | $SO_4^{2-}$ | 1.5 | 120 | 8.33 | 50 |
| | 28 | 1.50 | 0.55 | 0.268 | TMDDEA | 50 | 118 | 1 | $Na^+$, 40 | $SO_4^{2-}$ | 1.5 | 100 | 10.0 | 50 |
| | 29 | 1.05 | 0.50 | 0.322 | TMDDEB | 100 | 222 | 28 | — | $SO_4^{2-}$ | 1.5 | 100 | 10.0 | 50 |
| | 30 | 0.80 | 2.50 | 0.756 | TMDDEB | 50 | 122 | 1 | — | $SO_4^{2-}$ | 1.5 | 100 | 10.0 | 50 |

TMDDE indicates ethylene oxide addition product of 2,4,7,9-tetramethyl-5-decyne-4, 7-diol.
TMDDEA indicates a compound having a phenol group added to the ethylene oxide portion of TMDDE.
TMDDEB indicates a compound having a naphthol group added to the ethylene oxide portion of TMDDE.

TABLE 1-4

| Example | Coating Weight ($g/m^2$) | Plated Layer Composition Cr (wt %) | Plated Layer Composition Zn (wt %) | Powdering Resistance | Corrosion Resistance | Glossiness |
|---|---|---|---|---|---|---|
| 1 | 22 | 19.9 | Balance | ○ | ⊙ | ○ |
| 2 | 22 | 24.6 | Balance | Δ | ⊙ | ○ |

TABLE 1-4-continued

| Example | Coating Weight ($g/m^2$) | Plated Layer Composition Cr (wt %) | Plated Layer Composition Zn (wt %) | Powdering Resistance | Corrosion Resistance | Glossiness |
|---|---|---|---|---|---|---|
| 3 | 22 | 28.4 | Balance | Δ | ⊙ | ○ |
| 4 | 22 | 32.7 | Balance | Δ | ○ | ○ |
| 5 | 22 | 12.7 | Balance | ⊙ | ○ | ○ |
| 6 | 22 | 15.2 | Balance | ○ | ○ | ○ |
| 7 | 22 | 22.1 | Balance | ○ | ○ | ○ |
| 8 | 22 | 9.50 | Balance | ⊙ | ○ | ○ |
| 9 | 22 | 14.2 | Balance | ⊙ | ○ | ○ |
| 10 | 22 | 20.5 | Balance | ○ | ○ | ○ |

TABLE 1-5

| Example | Coating Weight ($g/m^2$) | Plated Layer Composition Cr (wt %) | Plated Layer Composition Zn (wt %) | Powdering Resistance | Corrosion Resistance | Glossiness |
|---|---|---|---|---|---|---|
| 11 | 22 | 12.6 | Balance | ⊙ | ○ | ○ |
| 12 | 22 | 12.6 | Balance | ⊙ | ○ | ○ |
| 13 | 22 | 6.81 | Balance | ○ | ○ | ○ |
| 14 | 22 | 9.53 | Balance | ⊙ | ○ | ○ |
| 15 | 22 | 10.6 | Balance | ⊙ | ○ | ○ |
| 16 | 22 | 13.6 | Balance | ⊙ | ○ | ○ |
| 17 | 22 | 16.9 | Balance | ○ | ○ | ○ |
| 18 | 22 | 8.79 | Balance | ○ | ○ | ○ |
| 19 | 22 | 12.5 | Balance | ⊙ | ○ | ○ |
| 20 | 22 | 13.2 | Balance | ⊙ | ○ | ○ |

TABLE 1-6

| Example | Coating Weight ($g/m^2$) | Plated Layer Composition Cr (wt %) | Plated Layer Composition Zn (wt %) | Powdering Resistance | Corrosion Resistance | Glossiness |
|---|---|---|---|---|---|---|
| 21 | 22 | 10.4 | Balance | ○ | ○ | ○ |
| 22 | 22 | 9.47 | Balance | ⊙ | ○ | ○ |
| 23 | 22 | 13.4 | Balance | ○ | ⊙ | ○ |
| 24 | 22 | 19.7 | Balance | Δ | ⊙ | Δ |
| 25 | 22 | 11.8 | Balance | ○ | ⊙ | ○ |
| 26 | 22 | 16.5 | Balance | ○ | ○ | Δ |
| 27 | 22 | 10.3 | Balance | ○ | ○ | ○ |
| 28 | 22 | 12.9 | Balance | ○ | ⊙ | ○ |
| 29 | 22 | 29.7 | Balance | Δ | ⊙ | Δ |
| 30 | 22 | 34.1 | Balance | Δ | ⊙ | Δ |

TABLE 2-1

| Comparative Example | $Zn^{2+}$ (mol/l) | $Cr^{3+}$ (mol/l) | $Cr^{3+}/(Zn^{2+}+Cr^{3+})$ | Organic Additive | Moles of Epoxy Groups Added | No. of Carbons per Molecule | Added Amount (g/l) | Conductive Auxiliary (g/l) | Anion | pH | Current Density ($A/dm^2$) | Current-Carrying Time (sec) | Bath Temperature (°C.) |
|---|---|---|---|---|---|---|---|---|---|---|---|---|---|
| 1 | 0.55 | 0.10 | 0.154 | TMDDE | 30 | 72 | 2 | $Na^+$, 50 | $SO_4^{2-}$ | 4.5 | 80 | 12.5 | 50 |
| 2 | 0.55 | 0.20 | 0.267 | TMDDE | 30 | 72 | 2 | $Na^+$, 50 | $SO_4^{2-}$ | 4.5 | 80 | 12.5 | 50 |
| 3 | 0.55 | 0.35 | 0.389 | TMDDE | 20 | 52 | 2 | $Na^+$, 50 | $SO_4^{2-}$ | 1.5 | 45 | 22.2 | 50 |
| 4 | 0.55 | 0.55 | 0.500 | TMDDE | 20 | 52 | 2 | $Na^+$, 50 | $SO_4^{2-}$ | 1.5 | 45 | 22.2 | 50 |
| 5 | 0.55 | 0.80 | 0.593 | TMDDE | 20 | 52 | 2 | $Na^+$, 50 | $SO_4^{2-}$ | 4.5 | 80 | 12.5 | 50 |
| 6 | 0.55 | 1.00 | 0.645 | TMDDE | 30 | 72 | 2 | $Na^+$, 50 | $SO_4^{2-}$ | 4.5 | 80 | 12.5 | 50 |
| 7 | 0.55 | 1.25 | 0.694 | TMDDE | 30 | 72 | 2 | $Na^+$, 50 | $SO_4^{2-}$ | 1.5 | 45 | 22.2 | 50 |
| 8 | 1.00 | 0.50 | 0.333 | TMDDE | 10 | 32 | 2 | $Na^+$, 50 | $SO_4^{2-}$ | 1.5 | 40 | 25.0 | 50 |
| 9 | 1.00 | 0.80 | 0.444 | TMDDE | 10 | 32 | 2 | $Na^+$, 50 | $SO_4^{2-}$ | 1.5 | 40 | 25.0 | 50 |
| 10 | 1.00 | 1.20 | 0.545 | TMDDE | 10 | 32 | 2 | $Na^+$, 50 | $SO_4^{2-}$ | 4.5 | 80 | 12.5 | 50 |
| 11 | 1.50 | 0.75 | 0.333 | TMDDE | 30 | 72 | 2 | $Na^+$, 50 | $SO_4^{2-}$ | 4.5 | 80 | 12.5 | 50 |
| 12 | 1.50 | 1.00 | 0.400 | TMDDE | 30 | 72 | 2 | $Na^+$, 50 | $SO_4^{2-}$ | 4.5 | 80 | 12.5 | 50 |
| 13 | 1.50 | 1.50 | 0.500 | TMDDE | 30 | 72 | 2 | $Na^+$, 50 | $SO_4^{2-}$ | 4.5 | 80 | 12.5 | 50 |
| 14 | 0.30 | 0.15 | 0.333 | TMDDE | 30 | 72 | 2 | $Na^+$, 50 | $SO_4^{2-}$ | 1.0 | 80 | 12.5 | 50 |
| 15 | 0.20 | 2.00 | 0.909 | TMDDE | 30 | 72 | 2 | $Na^+$, 50 | $SO_4^{2-}$ | 1.5 | 80 | 12.5 | 50 |

TMDDE indicates ethylene oxide addition product of 1,4,7,9-tetramethyl-5-decyne-4, 7-diol.

TABLE 2-2

| Comparative Example | $Zn^{2+}$ (mol/l) | $Cr^{3+}$ (mol/l) | $Cr^{3+}/(Zn^{2+}+Cr^{3+})$ | Organic Additive | Moles of Epoxy Groups Added | No. of Carbons per Molecule | Added Amount (g/l) | Conductive Auxiliary (g/l) | Anion | pH | Current Density ($A/dm^2$) | Current-Carrying Time (sec) | Bath Temperature (°C.) |
|---|---|---|---|---|---|---|---|---|---|---|---|---|---|
| 16 | 0.20 | 2.00 | 0.909 | TMDDE | 30 | 72 | 2 | $K^+$, 40 | $SO_4^{2-}$ | 2.5 | 80 | 12.5 | 50 |
| 17 | 1.20 | 0.50 | 0.294 | TMDDE | 30 | 72 | 2 | $K^+$, 40 | $SO_4^{2-}$ | 1.0 | 100 | 10.0 | 80 |
| 18 | 1.20 | 0.50 | 0.294 | TMDDE | 30 | 72 | 2 | $K^+$, 40 | $SO_4^{2-}$ | 1.0 | 120 | 8.33 | 80 |
| 19 | 1.20 | 0.50 | 0.294 | TMDDE | 30 | 72 | 2 | $K^+$, 40 | $SO_4^{2-}$ | 1.0 | 150 | 6.67 | 80 |
| 20 | 1.20 | 0.50 | 0.294 | TMDDE | 30 | 72 | 2 | $K^+$, 40 | $SO_4^{2-}$ | 1.0 | 180 | 5.56 | 80 |
| 21 | 1.20 | 0.50 | 0.294 | TMDDE | 30 | 72 | 2 | $K^+$, 40 | $SO_4^{2-}$ | 0.5 | 100 | 10.0 | 35 |
| 22 | 1.20 | 0.50 | 0.294 | TMDDE | 30 | 72 | 2 | $K^+$, 40 | $SO_4^{2-}$ | 0.5 | 100 | 10.0 | 60 |
| 23 | 1.20 | 0.50 | 0.294 | TMDDE | 30 | 72 | 2 | $K^+$, 40 | $SO_4^{2-}$ | 0.5 | 100 | 10.0 | 65 |
| 24 | 0.30 | 0.15 | 0.333 | TMDDE | 80 | 172 | 50 | $K^+$, 40 | $SO_4^{2-}$ | 1.0 | 100 | 10.0 | 60 |
| 25 | 0.30 | 0.15 | 0.333 | TMDDE | 100 | 212 | 0.05 | $K^+$, 40 | $SO_4^{2-}$ | 1.0 | 100 | 10.0 | 60 |
| 26 | 0.55 | 0.60 | 0.522 | — | — | — | 0 | $Na^+$, 40 | $SO_4^{2-}$ | 1.5 | 100 | 10.0 | 50 |
| 27 | 0.55 | 0.35 | 0.389 | — | — | — | 0 | $Na^+$, 40 | $SO_4^{2-}$ | 1.5 | 100 | 10.0 | 50 |
| 28 | 1.05 | 0.35 | 0.250 | — | — | — | 0 | $Na^+$, 40 | $SO_4^{2-}$ | 1.5 | 100 | 10.0 | 50 |
| 29 | 1.50 | 0.40 | 0.211 | — | — | — | 0 | $Na^+$, 40 | $SO_4^{2-}$ | 1.5 | 100 | 10.0 | 50 |

TMDDE indicates ethylene oxide addition product of 2,4,7,9-tetramethyl-5-decyne-4, 7-diol.

TABLE 2-3

| Example | Coating Weight ($g/m^2$) | Plated Layer Composition Cr (wt %) | Plated Layer Composition Zn (wt %) | Powdering Resistance | Corrosion Resistance | Glossiness |
|---|---|---|---|---|---|---|
| 1 | 8.3 | 11.3 | Balance | x | x | x |
| 2 | 8.4 | 11.2 | Balance | x | x | x |
| 3 | 22 | 3.2 | Balance | ⊙ | x | Δ |
| 4 | 22 | 3.2 | Balance | ⊙ | x | Δ |
| 5 | 8.0 | 10.6 | Balance | x | x | x |
| 6 | 7.2 | 8.4 | Balance | x | x | x |
| 7 | 22 | 3.0 | Balance | ⊙ | x | Δ |
| 8 | 22 | 1.9 | Balance | ⊙ | x | Δ |
| 9 | 22 | 1.6 | Balance | ⊙ | x | Δ |
| 10 | 8.3 | 8.0 | Balance | x | x | x |
| 11 | 11.2 | 10.6 | Balance | x | x | x |
| 12 | 10.6 | 9.2 | Balance | x | x | x |
| 13 | 6.9 | 6.3 | Balance | x | x | x |
| 14 | 19 | 12.6 | Balance | ○ | x | ○ |
| 15 | 18.3 | 42.6 | Balance | x | x | Δ |

TABLE 2-4

| Example | Coating Weight ($g/m^2$) | Plated Layer Composition Cr (wt %) | Plated Layer Composition Zn (wt %) | Powdering Resistance | Corrosion Resistance | Glossiness |
|---|---|---|---|---|---|---|
| 16 | 11.0 | 40.9 | Balance | x | x | x |
| 17 | 28 | 16.8 | Balance | Δ | ○ | Δ |
| 18 | 25 | 19.3 | Balance | Δ | ○ | Δ |
| 19 | 29 | 21.6 | Balance | Δ | ○ | Δ |
| 20 | 29 | 23.8 | Balance | Δ | ○ | Δ |
| 21 | 18.2 | 8.6 | Balance | ○ | x | ○ |
| 22 | 12.6 | 5.2 | Balance | ○ | x | ○ |
| 23 | 13.8 | 5.1 | Balance | ○ | x | ○ |
| 24 | 13.9 | 12.4 | Balance | Δ | Δ | Δ |
| 25 | 22 | 0.01 | Balance | x | x | x |
| 26 | 22 | 18.6 | Balance | x | ○ | x |
| 27 | 22 | 7.3 | Balance | x | x | x |
| 28 | 22 | 5.4 | Balance | x | x | x |
| 29 | 22 | 3.8 | Balance | x | x | x |

TABLE 3-1

| Example | $Zn^{2+}$ (mol/l) | $Cr^{3+}$ (mol/l) | $Cr^{3+}/(Zn^{2+}+Cr^{3+})$ | Organic Additive | Moles of Epoxy Groups Added | No. of Carbons per Molecule | Added Amount (g/l) | Conductive Auxiliary (g/l) | Anion | pH | Current Density ($A/dm^2$) | Current-Carrying Time (sec) | Bath Temperature (°C.) |
|---|---|---|---|---|---|---|---|---|---|---|---|---|---|
| 31 | 0.55 | 0.10 | 0.154 | TMDDE | 280 | 572 | 2 | $Na^+$, 50 | $SO_4^{2-}$ | 1.5 | 80 | 12.5 | 50 |
| 32 | 0.55 | 0.20 | 0.267 | TMDDE | 280 | 572 | 2 | $Na^+$, 50 | $SO_4^{2-}$ | 1.5 | 80 | 12.5 | 50 |
| 33 | 0.55 | 0.35 | 0.389 | TMDDE | 280 | 572 | 2 | $Na^+$, 50 | $SO_4^{2-}$ | 1.5 | 80 | 12.5 | 50 |
| 34 | 0.55 | 0.20 | 0.267 | TMDDEA | 200 | 420 | 2 | $Na^+$, 50 | $SO_4^{2-}$ | 1.0 | 100 | 10.0 | 60 |
| 35 | 1.05 | 0.25 | 0.179 | TMDDEB | 200 | 422 | 2 | $Na^+$, 80 | $SO_4^{2-}$ | 1.5 | 100 | 10.0 | 60 |
| 36 | 1.50 | 0.25 | 0.143 | TMDDEA | 200 | 418 | 1 | $Na^+$, 40 | $SO_4^{2-}$ | 1.5 | 100 | 10.0 | 50 |

TABLE 3-1-continued

| Example | $Zn^{2+}$ (mol/l) | $Cr^{3+}$ (mol/l) | $Cr^{3+}/(Zn^{2+}+Cr^{3+})$ | Organic Additive | Moles of Epoxy Groups Added | No. of Carbons per Molecule | Added Amount (g/l) | Conductive Auxiliary (g/l) | Anion | pH | Current Density (A/dm²) | Current-Carrying Time (sec) | Bath Temperature (°C.) |
|---|---|---|---|---|---|---|---|---|---|---|---|---|---|
| 37 | 1.05 | 0.50 | 0.322 | TMDDEB | 200 | 422 | 15 | — | $SO_4^{2-}$ | 1.5 | 100 | 10.0 | 50 |

TMDDE indicates ethylene oxide addition product of 2,4,7,9-tetramethyl-5-decyne-4, 7-diol.
TMDDEA indicates a compound having a phenyl group added to the ethylene oxide portion of TMDDE.
TMDDEB indicates a compound having a naphtol group added to the ethylene oxide portion of TMDDE.

TABLE 3-2

| | | Coating Weight (g/m²) | Plated Layer Composition Cr (wt %) | Plated Layer Composition Zn (wt %) | Powdering Resistance | Corrosion Resistance | Glossiness |
|---|---|---|---|---|---|---|---|
| Examples | 31 | 22 | 8.5 | Balance | ◎ | ○ | ○ |
| | 32 | 22 | 11.2 | Balance | ◎ | ○ | ○ |
| | 33 | 22 | 13.0 | Balance | ○ | ○ | ○ |
| | 34 | 22 | 11.5 | Balance | ○ | ○ | ○ |
| | 35 | 22 | 9.4 | Balance | ○ | ○ | ○ |
| | 36 | 22 | 8.8 | Balance | ○ | ○ | ○ |
| | 37 | 22 | 26.5 | Balance | Δ | ◎ | Δ |

Examples 38 to 43

A zinc-chromium alloy-plated steel sheet was produced by plating the same steel sheet as that used in Examples 1 to 37 under the same conditions with the exception that $Fe^{2+}$, $Ni^{2+}$, $Co^{2+}$, $Al_2O_3$, $SiO_2$ or $TiO_2$ was added in an amount shown in Tables 4—1, 4—2, 5—1 and 5—2 to produce a zinc-chromium alloy-plated steel sheet with a plated layer containing one of the above substances. The powdering resistance and the corrosion resistance after processing were evaluated under the above-described conditions. The results obtained are shown in Tables 4—1, 4—2, 5—1 and 5—2.

In the tables, TMDD indicates 2,4,7,9-tetramethyl-5-decyne-4,7-diol, and TMDDE an ethylene oxide addition product of TMDD.

TABLE 4-1

| Example | $Zn^{2+}$, $Cr^{3+}$, $Cr^{3+}/(Zn^{2+}+Cr^{3+})$ | $Fe^{2+}$ (mol/l) | $Ni^{2+}$ (mol/l) | $Co^{2+}$ (mol/l) | Organic Additive | Moles of Epoxy Groups Added | No. of Carbons per Molecule | Added Amount (g/l) | Conductive Auxiliary (g/l) | Anion | pH | Current Density (A/dm²) | Current-Carrying Time (sec) | Bath Temp. (°C.) |
|---|---|---|---|---|---|---|---|---|---|---|---|---|---|---|
| 38 | 1) | 0.45 | 0 | 0 | TMDDE | 30 | 72 | 2 | $Na^+$, 50 | $SO_4^{2-}$ | 1.5 | 100 | 10 | 60 |
| 39 | 1) | 0 | 0.50 | 0 | TMDDE | 30 | 72 | 2 | $Na^+$, 50 | $SO_4^{2-}$ | 1.5 | 100 | 10 | 60 |
| 40 | 1) | 0 | 0 | 0.45 | TMDDE | 30 | 72 | 2 | $Na^+$, 50 | $SO_4^{2-}$ | 1.5 | 100 | 10 | 60 |

TMDDE indicates ethylene oxide addition product of 2,4,7,9-tetramethyl-5-decyne-4, 7-diol.
1) $Zn^{2+}$: 1.20 mol/l, $Cr^{3+}$: 0.60 mol/l, $Cr^{3+}/(Zn^{2+}+Cr^{3+})$: 0.333
The plating bath was a sulfate bath

TABLE 4-2

| | | Coating Weight (g/m²) | Zn (wt %) | Cr (wt %) | Fe (wt %) | Ni (wt %) | Co (wt %) | Adhesiveness | Corrosion Resistance | Glossiness |
|---|---|---|---|---|---|---|---|---|---|---|
| Example | 38 | 22 | Balance | 9 | 9 | — | — | ○ | ○ | ○ |
| | 39 | 22 | Balance | 10 | — | 10 | — | ○ | ○ | ○ |
| | 40 | 22 | Balance | 10 | — | — | 6 | ○ | ◎ | ○ |

TABLE 5-1

| Example | $Zn^{2+}$, $Cr^{3+}$, $Cr^{3+}/(Zn^{2+}+Cr^{3+})$ | $Al_2O_3$ (mol/l) | $SiO_2$ (mol/l) | $TiO_2$ (mol/l) | Organic Additive | Moles of Epoxy Groups Added | No. of Carbons per Molecule | Added Amount (g/l) | Conductive Auxiliary (g/l) | Anion | pH | Current Density (A/dm²) | Current-Carrying Time (sec) | Bath Temp. (°C.) |
|---|---|---|---|---|---|---|---|---|---|---|---|---|---|---|
| 41 | 1) | 7.0 | 0 | 0 | TMDDE | 100 | 214 | 2 | $Na^+$, 40 | $SO_4^{2-}$ | 2.5 | 80 | 12.5 | 60 |
| 42 | 1) | 0 | 5.0 | 0 | TMDDE | 100 | 214 | 2 | $Na^+$, 40 | $SO_4^{2-}$ | 1.5 | 80 | 12.5 | 60 |
| 43 | 1) | 0 | 0 | 5.5 | TMDDE | 100 | 214 | 2 | $Na^+$, 40 | $SO_4^{2-}$ | 1.5 | 80 | 12.5 | 60 |

TMDDE indicates ethylene oxide addition product of 2,4,7,9-tetramethyl-5-decyne-4, 7-diol.
1) $Zn^{2+}$: 1.20 mol/l, $Cr^{3+}$: 0.60 mol/l, $Cr^{3+}/(Zn^{2+}+Cr^{3+})$: 0.333
The plating bath was a sulfate bath

TABLE 5-2

| | | Coating Weight ($g/m^2$) | Zn (wt %) | Cr (wt %) | Fe (wt %) | Ni (wt %) | Co (wt %) | Adhesiveness | Corrosion Resistance | Glossiness |
|---|---|---|---|---|---|---|---|---|---|---|
| Example | 41 | 22 | Balance | 9 | 0.8 | — | — | ○ | ◎ | ○ |
| | 42 | 22 | Balance | 10 | — | 0.7 | — | ○ | ◎ | ○ |
| | 43 | 22 | Balance | 10 | — | — | 0.7 | ○ | ○ | ○ |

ADVANTAGES OF THE INVENTION

As described above, the use of the organic additive disclosed in the present invention permits the formation of a zinc-chromium alloy-plated steel sheet having excellent plate adhesion and excellent corrosion resistance. In addition, the method of the present invention uses a plating bath with excellent stability, and thus permits stable production of a plated steel sheet on an industrial scale. It is very significant that the present invention enables the industrial production of a zinc-chromium alloy-plated steel sheet having excellent plate adhesion and excellent corrosion resistance.

What is claimed is:

1. A method of producing a zinc-chromium alloy-plated steel sheet with excellent plating adhesiveness, comprising plating the surface of said steel sheet using an acid plating bath containing zinc ion ($Zn^{2+}$) and chromium ion ($Cr^{3+}$) at a molar concentration ratio of about $0.1 + Cr^{3+}/(Zn^{3+} + Cr^{3+}) \leqq 0.9$ in a total amount of at least about 0.5 mol/l within the dissolution range, and about 0.1 to 30 g/l of at least one nonionic organic additive having at least a triple bond, at a bath temperature of about 25° to 70° C. and pH of about 1.0 to 4.0 with a current density of about 50 to 200 $A/dm^2$.

2. A method of producing a zinc-chromium alloy-plated steel sheet with excellent plating adhesiveness according to claim 1, wherein said nonionic organic additive having at least a triple bond is expressed by the following formulas:

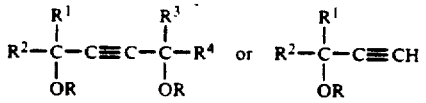

wherein the number of carbon atoms which form a molecule is within the range of from about 10 to 800, wherein $R^1$, $R^2$, $R^3$ and $R^4$ each being at least one selected from a group consisting of phenyl group, naphthalene group, anthracene group, phenol group, naphthol group, anthranol group, alkyl-group adducts and/or alkylene-group adducts and/or sulfonic acid-group adducts of these groups, hydrogen, hydroxyl group, alkyl group, alkylene group, alkoxyl group or its polymer, and sulfonic acid group, and wherein R is at least one selected from a group consisting of hydrogen, alkoxyl group or its polymer.

3. A method of producing a zinc-chromium alloy-plated steel sheet with excellent plating adhesiveness according to claim 2, wherein said nonionic organic additive having at least a triple bond is selected from the group consisting of the acetylene alcohols, acetylene glycols and derivatives thereof.

4. A method of producing a zinc-chromium alloy-plated steel sheet with excellent plate adhesion according to claim 2, wherein the number of carbon atoms in said additive having at least a triple bond is about 10 to 250.

* * * * *

UNITED STATES PATENT AND TRADEMARK OFFICE

CERTIFICATE OF CORRECTION

PATENT NO. : 5,273,643

DATED : December 28, 1993

INVENTOR(S) : Kazuhiro Hasegawa et al

It is certified that error appears in the above-indentified patent and that said Letters Patent is hereby corrected as shown below:

In Column 1, Line 7, delete "2.";
Line 12, delete "1.";
Line 62, delete "TO" and substitute --OT--.

In Column 2, Line 17, delete "cationpolymer" and substitute --cation polymer--;
Line 20, delete "cationpolymer" and substitute --cation polymer--;
Line 21, delete "cationpolymer" and substitute --cation polymer--.

In Column 6, Line 41, delete "TO" and substitute --OT--.

In Column 9, Table 1-6, under the column entitled "Powdering Resistance",
Line 1, delete "O" and substitute --◎--;
Table 1-6, under the column entitled "Corrosion Resistance",
Line 5, delete "◎" and substitute --O--;
Line 6, delete "O" and substitute --◎--.

UNITED STATES PATENT AND TRADEMARK OFFICE

CERTIFICATE OF CORRECTION

PATENT NO. : 5,273,643

DATED : December 28, 1993

INVENTOR(S) : Kazuhiro Hasegawa et al

It is certified that error appears in the above-identified patent and that said Letters Patent is hereby corrected as shown below:

In Column 15, Line 29, delete +, first occurrence, and substitute --≤--.

Signed and Sealed this

Seventeenth Day of May, 1994

*Attest:*

Bruce Lehman

BRUCE LEHMAN

*Attesting Officer*

*Commissioner of Patents and Trademarks*